United States Patent [19]

Thomas

[11] 4,111,305

[45] Sep. 5, 1978

[54] PACKAGED DINNER SERVING TRAY

[76] Inventor: Claude E. Thomas, 7066 Stone Brook, West Bloomfield, Mich. 48010

[21] Appl. No.: 835,055

[22] Filed: Sep. 21, 1977

[51] Int. Cl.[2] ..... B65D 1/34

[52] U.S. Cl. ..... 206/563; 206/564; 224/48 R

[58] Field of Search ..... 224/48 R, 48 A, 48 C, 224/46 T, 45 A; 206/562, 563, 557, 564; 220/70

[56] References Cited

U.S. PATENT DOCUMENTS

| | | | |
|---|---|---|---|
| 2,213,837 | 9/1940 | Gill | 224/48 R |
| 2,545,528 | 3/1951 | Murray | 220/17 |
| 2,723,068 | 11/1955 | Ettwein | 224/48 R |
| 2,826,346 | 3/1958 | Randall | 224/48 R |
| 3,622,036 | 11/1971 | Bongaerts | 220/70 |
| 3,670,938 | 6/1972 | Brocato | 224/48 R |
| 3,697,223 | 10/1972 | Kovalcik et al. | 206/563 |
| 3,760,996 | 9/1973 | Campbell | 224/48 R |

FOREIGN PATENT DOCUMENTS

| | | | |
|---|---|---|---|
| 2,506,216 | 8/1976 | Fed. Rep. of Germany | 224/48 R |

*Primary Examiner*—William Price
*Assistant Examiner*—Bruce H. Bernstein
*Attorney, Agent, or Firm*—Cullen, Sloman, Cantor, Grauer, Scott & Rutherford

[57] ABSTRACT

A packaged dinner serving tray being of a one piece, lightweight plastic construction having a central cavity for holding the standard packaged dinner and having support portions for holding the packaged dinner in the cavity spaced above the surface on which the tray is placed (i.e. such as a table) and having opposite side openings to facilitate handling and serving of packaged dinner in the tray.

5 Claims, 3 Drawing Figures

PACKAGED DINNER SERVING TRAY

SUMMARY BACKGROUND OF THE INVENTION

The present invention relates to a serving tray for holding and serving a packaged dinner such as a frozen or T.V. type dinner.

Packaged dinners are conventionally packaged in an aluminum tray and are usually frozen. Dinner can be prepared simply by heating the packaged dinner in its original aluminum tray. The present invention provides a serving tray which has a cavity for receiving the heated packaged dinner such that it can now be conveniently handled and served.

The serving tray provides means for being easily gripped and also means for support on a surface upon which it is to be placed, i.e. a table, with the cavity spaced above that surface to preclude possible heat damage to that surface.

Therefore, it is an object of the present invention to provide a serving tray for a packaged dinner in which the tray has means for supporting the package when heated and providing means for gripping the serving tray.

It is another object to provide a tray of the above described type having means for supporting the tray with the package receiving cavity located above the surface upon which it is placed.

It is another general object of the present invention to provide a new and novel serving tray for use with packaged dinners.

Other objects, features, and advantages of the present invention will become apparent from the subsequent description and the appended claims, taken in conjunction with the accompanying drawings, in which:

Figure 1:
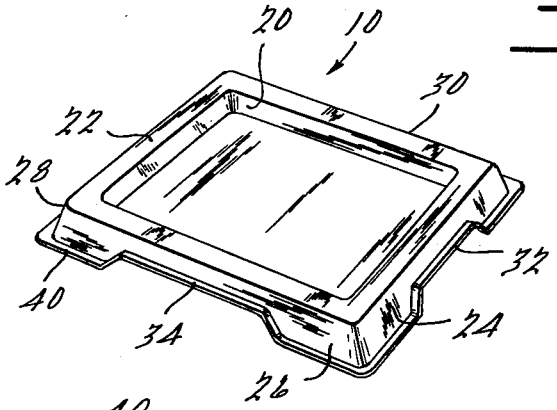
FIG. 1 is an isometric view of a serving tray of the present invention.
Figure 2:
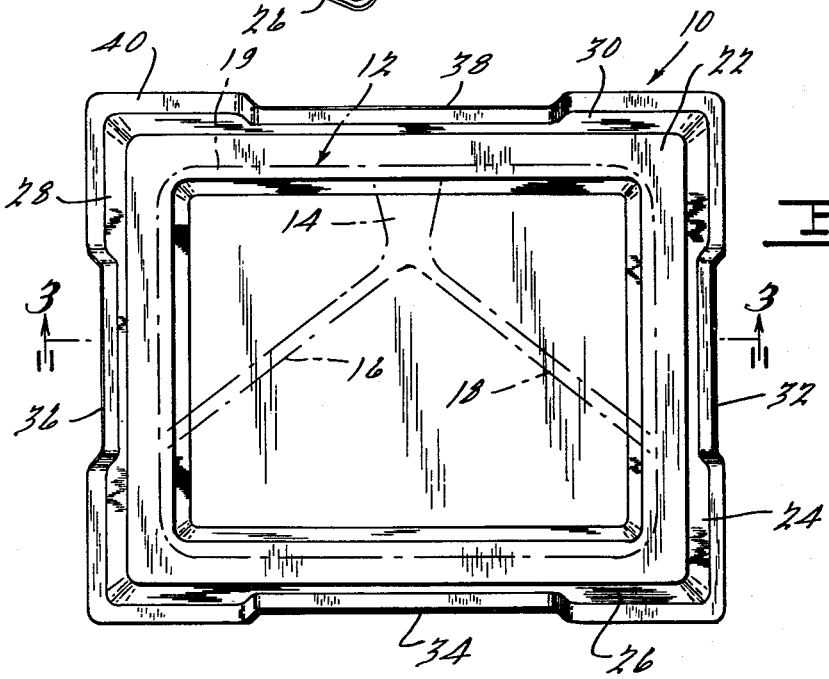
FIG. 2 is a top elevational view of the serving tray of FIG. 1 with a packaged dinner supported therein shown in phantom.
Figure 3:
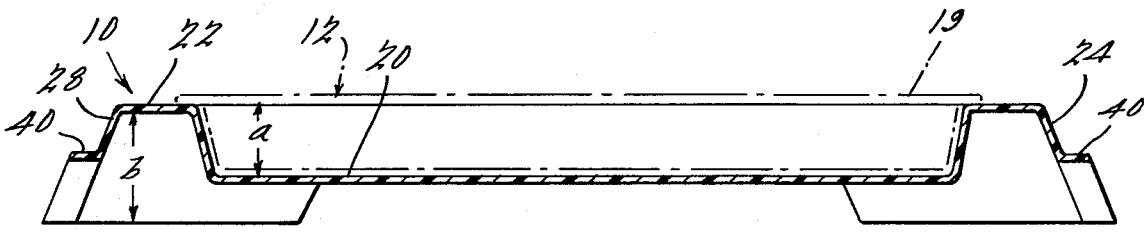
FIG. 3 is a sectional view of the serving tray of FIG. 2 taken generally along the line 3—3 in FIG. 2 with a packaged dinner shown in phantom.

Looking now to the drawing, a serving tray 10 is shown and in FIGS. 2 and 3 the serving tray 10 is shown supporting a typical packaged dinner tray 12. The dinner tray 12 can be of the typical aluminum construction utilized for frozen packaged dinners having a series of compartments defined by separating ridges 14, 16 and 18, and having an outer upper rim 19.

The serving tray 10 has a central cavity 20 which is of a size generally similar to the outside configuration of the dinner tray 12. The cavity 20 is closed at the bottom and is surrounded by a generally planar upper surface 22. The cavity 20 is of a depth to receive the dinner tray 12 with the outer rim 19 located proximate to the outer surface 22.

The serving tray 10 has four side walls 24, 26, 28 and 30 which depend downwardly and outwardly from the planar surface 22. The side walls 24–30 are provided with generally centrally located ridges 32, 34, 36 and 38, respectively. The ridges 32–38 are provided to permit gripping by hand and hence are wide enough to permit insertion of the fingers of the hands and high enough to permit easy gripping when the serving tray is placed on a surface.

The side walls 24–30, including the ridges 32–38, terminate in an outwardly transversely extending flange 40. The flange 40 improves the rigidity of the side walls 24–30 and provides a stable support surface at each of the corners defined by the junctures of side walls 24, 26 and 26, 28 and 28, 30 and 30, 24. In the area of the ridges 32–38 the flange 40 improves the ability of the user to grip the serving tray.

The depth "a" of the cavity 20 of the serving tray 10 is selected to be proximate the depth of the dinner tray 12. The depth "a", however, is less than the height b at the corners defined by the side walls 24–30 such that the bottom of the cavity 20 of the serving tray 10 will be located a preselected distance above the surface upon which it is set. The distance need not exceed 0.250 inch but just sufficient to provide adequate clearance to prevent the possibility of any heat damage to the surface upon which the serving tray 10 will be located.

Thus with the construction as shown a hot dinner tray 12 can be easily handled without danger of burning the user or the surface upon which it is set.

The serving tray 10 is preferably made of a one piece plastic construction having a uniform thickness. In one form the tray 10 was vacuum formed. It should preferably be made of a thin gauge i.e. between 0.030 inch and 0.060 inch such that it has adequate structural capability but is lightweight and inexpensive.

The bottom surface of the flange 40 can be roughened or otherwise provided with a frictional surface to inhibit sliding of the serving tray 10.

While it will be apparent that the preferred embodiment of the invention disclosed is well calculated to fulfill the objects above stated, it will be appreciated that the invention is susceptible to modification, variation and change without departing from the proper scope or fair meaning of the invention.

What is claimed is:

1. A serving tray for holding a packaged dinner tray with the packaged dinner tray having a predetermined shape and an outwardly extending peripheral flange, said serving tray being generally rectangular in shape and having a central cavity formed therein, said central cavity being a preselected shape similar to the predetermined shape of the dinner tray whereby the dinner tray can be received in said cavity, said cavity having a flat lower wall to support the bottom of said packaged dinner tray against buckling and puncture during use, said lower wall terminating in upwardly formed side walls to define said cavity side walls terminating in a planar upper surface surrounding said cavity, said planar upper surface being generally parallel to said lower wall and forming an upper support surface for said dinner tray peripheral flange, four outer side walls depending downwardly from said upper surface, said four outer side walls terminating in a transversely extending lower peripheral flange, support surfaces defined by said lower peripheral flange at the juncture of adjacent ones of said outer side walls said lower wall being spaced upwardly from said support surfaces such that when said serving tray is placed on a table said lower wall is out of contact from the table top to avoid condensation or other damage to said table top, and an elongated notch formed in each of at least two opposed of said side walls to provide the dual functions of (a) permitting gripping of said tray by the user thereof and (b) to permit air to circulate freely from outside of said tray to the underside of said flat lower wall to remove condensation thereform.

2. The serving tray of claim 1 being constructed of one piece and having a generally uniform wall thickness throughout.

3. The serving tray of claim 2 with said wall thickness being in a range of from about 0.030 inch to about 0.060 inch.

4. The serving tray of claim 2 with said support surfaces being roughened to inhibit slipping.

5. The serving tray of claim 1 wherein an elongated notch is formed in each of said four outer side walls.

* * * * *